US010131479B2

(12) United States Patent
Burattini

(10) Patent No.: US 10,131,479 B2
(45) Date of Patent: Nov. 20, 2018

(54) SEALED SINGLE-DOSE BREAK-OPEN PACKAGE SUITED TO BE OPENED VERTICALLY

(71) Applicant: EASYSNAP TECHNOLOGY S.R.L., San Giovanni in Persiceto (IT)

(72) Inventor: Christian Burattini, San Giovanni in Persiceto (IT)

(73) Assignee: Easysnap Technology S.r.l., San Giovanni in Persiceto (IT)

( * ) Notice: Subject to any disclaimer, the term of this patent is extended or adjusted under 35 U.S.C. 154(b) by 122 days.

(21) Appl. No.: 15/307,129

(22) PCT Filed: Apr. 30, 2015

(86) PCT No.: PCT/IB2015/053163
§ 371 (c)(1),
(2) Date: Oct. 27, 2016

(87) PCT Pub. No.: WO2015/166453
PCT Pub. Date: Nov. 5, 2015

(65) Prior Publication Data

US 2017/0043925 A1 Feb. 16, 2017

(30) Foreign Application Priority Data

Apr. 30, 2014 (IT) ..... BO2014A0249

(51) Int. Cl.
*B65D 75/58* (2006.01)
*B65D 75/28* (2006.01)
*B65D 75/30* (2006.01)

(52) U.S. Cl.
CPC ..... *B65D 75/585* (2013.01); *B65D 75/28* (2013.01); *B65D 75/30* (2013.01)

(58) Field of Classification Search
CPC .. B65D 75/585; B65D 75/5827; B65D 75/28; B65D 75/30; B65D 75/58
(Continued)

(56) References Cited

U.S. PATENT DOCUMENTS 3,472,368 A * 10/1969 Hellstrom ..... B65D 75/32 206/469
3,986,640 A * 10/1976 Redmond ..... B65D 75/30 206/469
(Continued)

FOREIGN PATENT DOCUMENTS

EP 2628691 A1 8/2013
WO 2008038074 A2 4/2008
(Continued)

OTHER PUBLICATIONS

International Search Report and Written Opinion dated Jul. 17, 2015 from International Patent Application No. PCT/IB2015/053163 filed Apr. 30, 2015.
(Continued)

*Primary Examiner* — Steven A. Reynolds
(74) *Attorney, Agent, or Firm* — Sunstone IP

(57) ABSTRACT

A sealed single-dose break-open package having: a first sheet of semi-rigid plastic material; a second sheet of flexible plastic material superimposed on and sealed to the first sheet of semi-rigid plastic material to define a sealed pocket containing a dose of a product; and a pre-weakened area, which extends transversely and is obtained in a central area of the first sheet, so as to guide, following a folding of the sealed package, a controlled breakage of the first sheet in correspondence to the pre-weakened area; the pre-weakened area has a single inner incision, which is oriented transversely and is obtained through an inner surface of the first sheet, and a single outer incision, which is oriented transversely, is obtained through an outer surface of the first
(Continued)

sheet, and is transversely staggered relative to and longitudinally aligned with the inner incision.

10 Claims, 5 Drawing Sheets

(58) Field of Classification Search
USPC ..... 206/469, 484
See application file for complete search history.

(56) References Cited

U.S. PATENT DOCUMENTS 4,236,652 A * 12/1980 Beguhn ..... B65D 75/26 222/92
4,493,574 A * 1/1985 Redmond ..... B65D 75/368 206/469
5,395,031 A * 3/1995 Redmond ..... B65D 75/367 206/469
7,121,409 B1 * 10/2006 Hamilton ..... B65B 9/042 206/484.2
2003/0089625 A1 * 5/2003 Moodie ..... B65D 75/585 206/204
2005/0178086 A1 * 8/2005 Bakken ..... B65B 61/02 53/412
2006/0283727 A1 * 12/2006 Nelson ..... B65B 61/02 206/219
2007/0289891 A1 * 12/2007 Davies ..... B65D 75/585 206/484
2010/0065582 A1 3/2010 Nelson et al.
2010/0264044 A1 * 10/2010 Beihoffer ..... A45D 34/04 206/204
2015/0307260 A1 * 10/2015 Reggio ..... B65D 83/0445 206/531

FOREIGN PATENT DOCUMENTS

WO 2009040629 A2 4/2009
WO 2010100531 A2 9/2010

OTHER PUBLICATIONS

Search Report dated Oct. 8, 2014 from Italian Patent Application No. 8020140230 filed Apr. 22, 2014.

* cited by examiner

SEALED SINGLE-DOSE BREAK-OPEN PACKAGE SUITED TO BE OPENED VERTICALLY

CROSS REFERENCE TO RELATED APPLICATION(S)

This application is a U.S. National Stage Entry of International Patent Application No. PCT/IB2015/053163, filed Apr. 30, 2015, which claims the benefit of Italian Patent Application No. BO2014A000249, filed Apr. 30, 2014, the disclosures of which are hereby incorporated entirely herein by reference.

BACKGROUND

Technical Field

The present invention relates to a sealed single-dose break-open package.

Prior Art

Patent application WO2009040629A2 describes a sealed single-dose break-open package; the package comprises a sheet of semirigid plastic material and a sheet of flexible plastic material, which is set on top of and welded to the first sheet of semirigid plastic material, so as to define a sealed pocket that contains a dose of a fluid product. The sheet of semirigid plastic material centrally has a pre-weakened area, which guides a controlled breakage of the sheet of semirigid plastic material, in order to cause the formation of an outlet opening for the product through the sheet of semirigid plastic material itself. In other words, in order to open the sealed package, a user must grab the sealed package with the fingers of a hand and fold the sealed package in a "V" shape, until the sheet of semirigid plastic material brakes in correspondence to the pre-weakened area. The pre-weakened area comprises an inner incision, which is obtained through an inner surface (namely, one facing the pocket) of the sheet of semirigid plastic material, and an outer incision, which is obtained through an outer surface of the sheet of semirigid plastic material and is aligned with the inner incision.

The sealed package described in patent application WO2009040629A2 is designed to be opened by being arranged horizontally and with the sheet of semirigid plastic material (having the pre-weakened area) oriented downwards. In other words, in order to ensure a correct outlet of the product, the sealed package must be arranged horizontally and with the sheet of semirigid plastic material (having the pre-weakened area) oriented downwards; starting from this position, the user must fold the sealed package in a "V" shape, until the sheet of semirigid plastic material brakes in correspondence to the pre-weakened area to let the product out.

Recently, uses of a sealed single-dose package have been suggested, which require a high precision in the product outlet direction, as the product must be fed into a relatively small-sized opening (for example, a hole having a diameter smaller than one centimeter). In other words, the user, by folding the sealed package in a "V" shape, must be able to easily and accurately direct the product, so as to hit the centre of a relatively small-sized opening arranged under the sealed package. However, the sealed package described in patent application WO2009040629A2 is not suited for these uses, since it requires the sealed package to be opened from a horizontal position (in which the sealed package hides from the user's view the opening that lies under it and must be hit by the product, thus making the operation complicated and uncertain); furthermore, the product flows out of the "V"-folded sealed package with a relatively accidental and hardly foreseeable direction, thus making the operation even more complicated and uncertain.

DESCRIPTION OF THE INVENTION

The object of the present invention is to provide a sealed single-dose break-open package, which is designed to eliminate the aforementioned drawbacks and, in particular, can be manufactured in a straightforward and relatively low-cost manner.

According to the present invention, there is provided a sealed single-dose break-open package according to the appended claims.

BRIEF DESCRIPTION OF THE DRAWINGS

The present invention will now be described with reference to the accompanying drawings, which show a non-limiting embodiment thereof, wherein.

PREFERRED EMBODIMENTS OF THE INVENTION DRAWINGS

Figure 2:
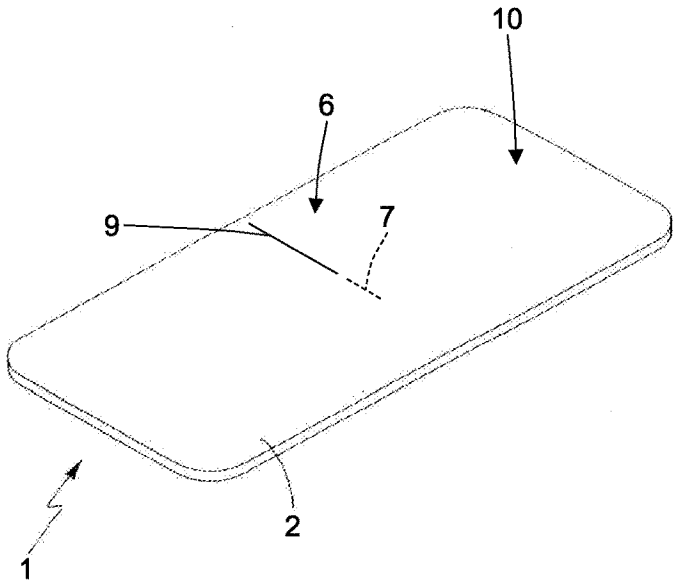
FIG. 2 shows a lower perspective view of the sealed package of FIG. 1.
Figure 1:
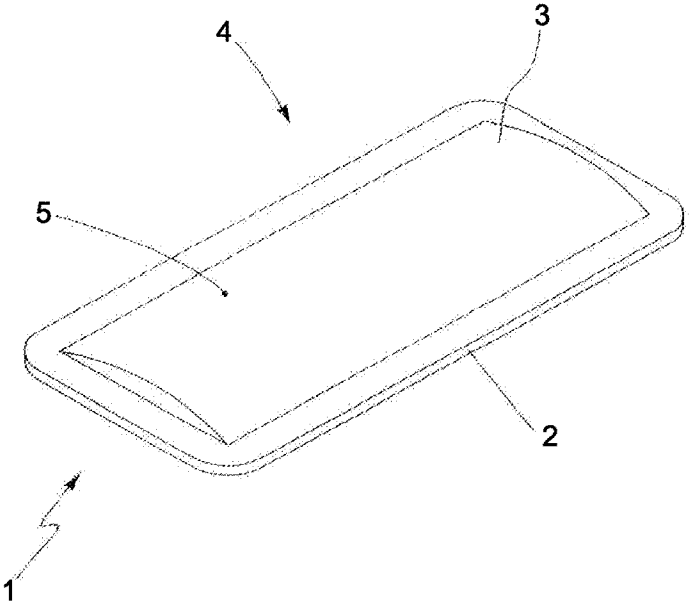
FIG. 1 shows an upper perspective view of a sealed single-dose break-open package according to the present invention.

In FIGS. 1 and 2, number 1 indicates, as a whole, a sealed single-dose break-open package. The sealed package 1 comprises a sheet 2 of semirigid plastic material with a rectangular shape and a sheet 3 of flexible plastic material, which is superimposed on and sealed to the sheet 2 of semirigid plastic material to define a sealed pocket 4 containing a dose of a fluid product 5.

Figure 4:
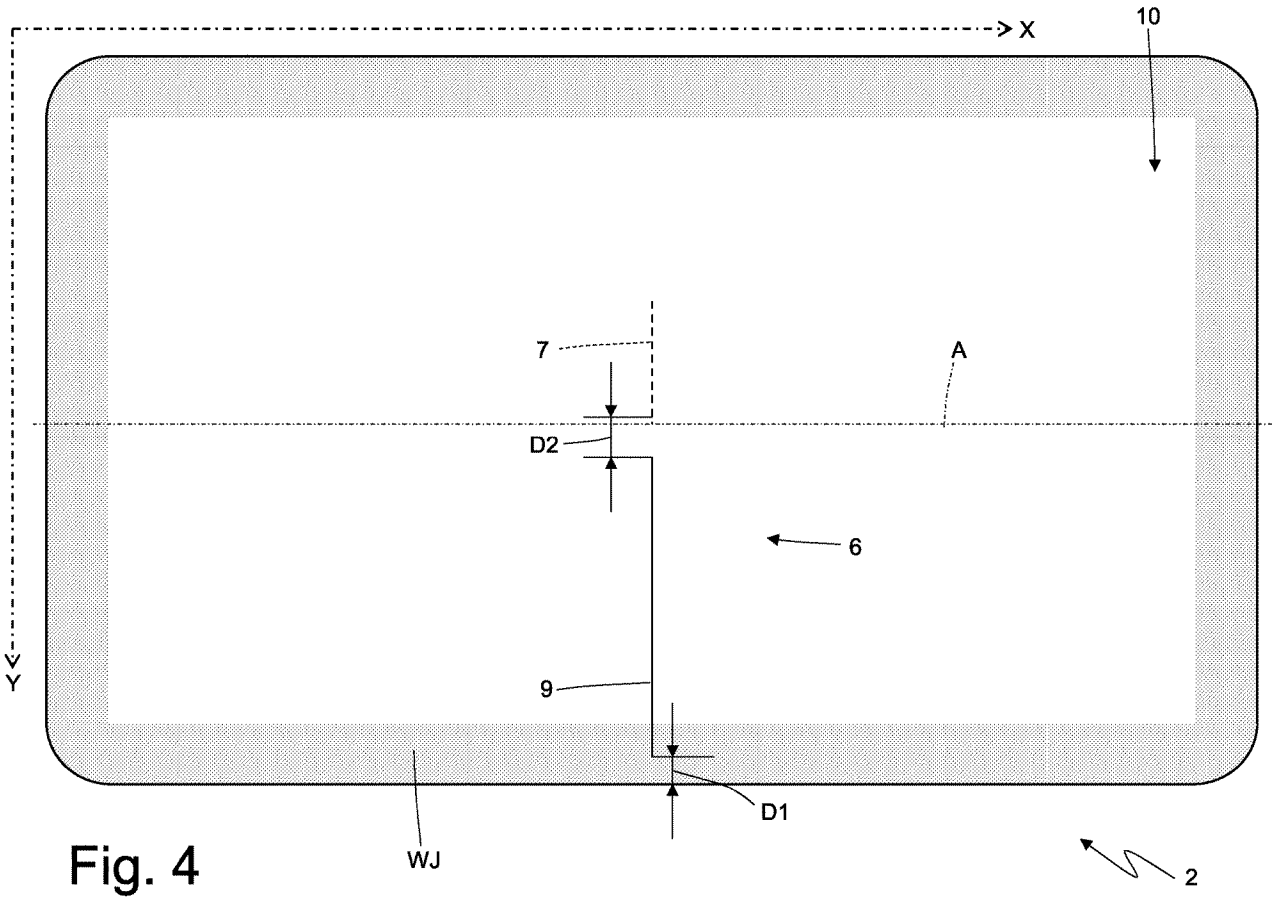
FIG. 4 is a view from the bottom of the sealed package of FIG. 1.

According to FIG. 4, the sealed package 1 has a rectangular shape and has a longitudinal direction X (parallel to the longer sides of the rectangle) as well as a transverse direction Y (parallel to the shorter sides of the rectangle), which is perpendicular to the longitudinal direction X. FIG. 4 also shows a longitudinal middle axis A, which divides in half the sealed package 1.

Figure 5:
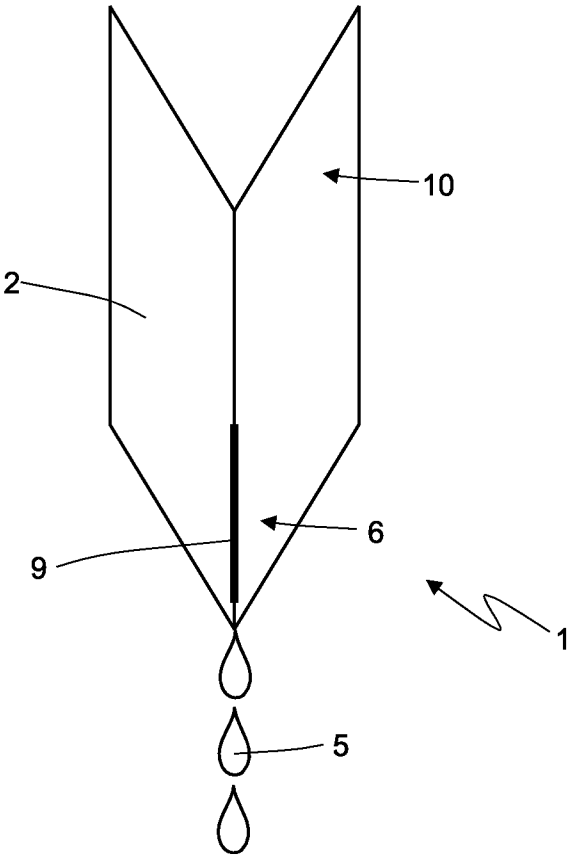
FIG. 5 is a schematic, perspective view of the sealed package of FIG. 1 during the opening of the sealed package itself.

The sheet 2 of semirigid plastic material centrally has a pre-weakened area 6, which is obtained in a central area of the sheet 2 of semirigid plastic material (in particular, in a longitudinally centred area, namely centred along the longitudinal axis X), extends transversely (namely, parallel to the transverse direction Y and, therefore, parallel to the shorter sides of the sheet 2 of semirigid plastic material), and guides a controlled breakage of the sheet 2 of semirigid plastic material, in order to cause the formation of an outlet opening for the product 5 through the sheet 2 of semirigid plastic material. In other words, in use, in order to open the sealed package 1, a user must grab the sealed package 1 with the fingers of a hand and fold the sealed package 1 in a "V"

shape (as shown in FIG. 5), until the sheet 2 of semirigid plastic material brakes in correspondence to the pre-weakened area 6. By breaking the sheet 2 of semirigid plastic material in correspondence to the pre-weakened area, the product 5 can be let out of the sealed package 1 in a simple and hygienic manner.

Figure 3:
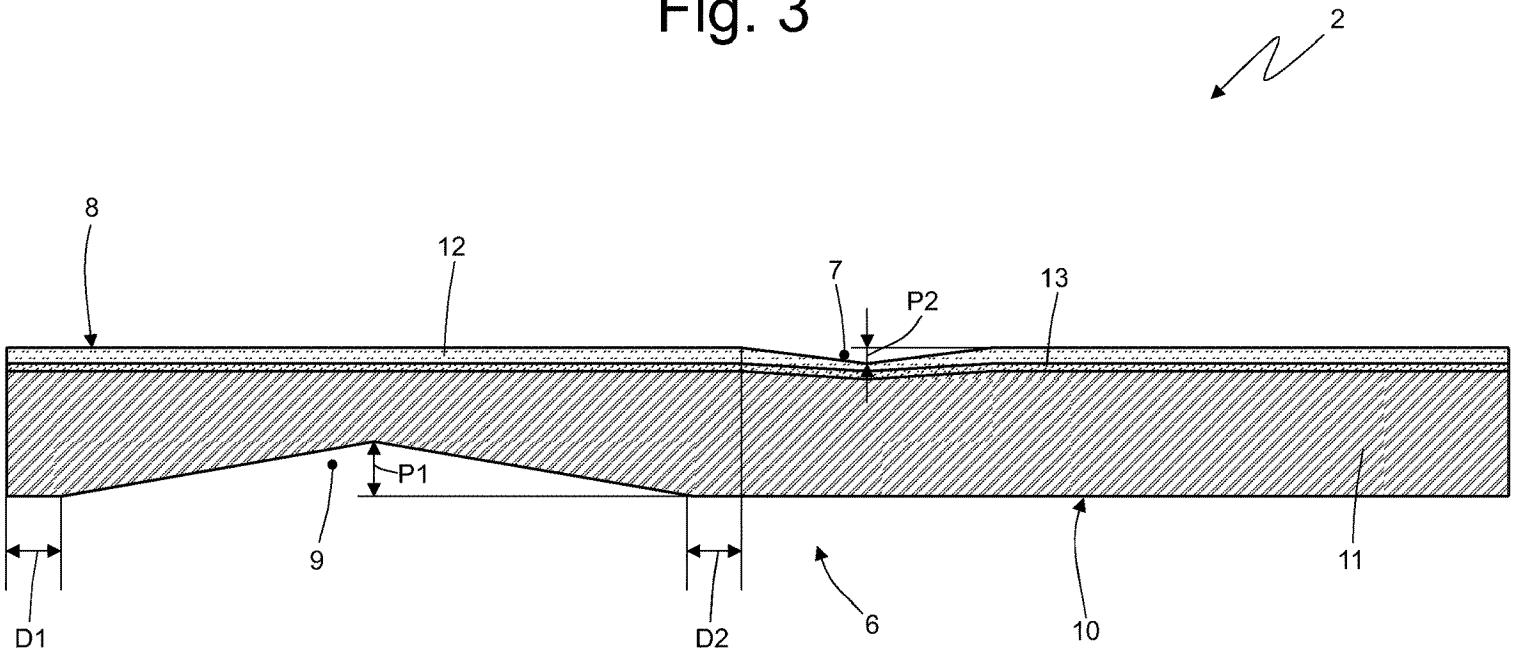
FIG. 3 is a schematic, cross-sectional view, in correspondence to a pre-weakened area, of the sealed package of FIG. 1.

According to FIG. 3, the pre-weakened area 6 comprises a single inner incision 7, which is oriented transversely and is obtained through an inner surface 8 (namely, one facing the pocket 4) of the sheet 2 of semirigid plastic material, and a single outer incision 9, which is oriented transversely and is obtained through an outer surface 10 of the sheet 2 of semirigid plastic material. As shown more in detail in FIG. 4, the outer incision 9 is transversely staggered relative to and longitudinally aligned with the inner incision 7, namely the two incisions 7 and 9 are longitudinally aligned with one another (i.e. along the longitudinal direction X) and are transversely staggered relative to one another (i.e. along the transverse direction y).

According to a preferred, though not binding embodiment shown in FIG. 3, the sheet 2 of semirigid plastic material is made up of a laminate consisting of a bearing layer 11 arranged on the outside and of a heat-sealable layer 12 arranged on the inside (namely, in contact with the sheet 3 of flexible plastic material). Between the bearing layer 11 and the heat-sealable layer 12 there is provided a further barrier or insulating layer 13, which has the task of ensuring air- and/or light-tightness. By way of non-limiting example, the sheet 2 of semirigid plastic material might be made up of a bearing layer 11 of white polystyrene (PS) having a thickness of 380 micron (±10%), a barrier layer 13 of "Evoh" having a thickness of 5 micron (±10%), and a heat-sealable layer 12 of polyethylene (PE) having a thickness of 70 micron (±10%).

The outer incision 9 is obtained in the outer wall 10 of the sheet 2 of semirigid plastic material and is made by locally deforming the sheet 2 of semirigid plastic material and, in particular, the bearing layer 11 of the sheet 2 of semirigid plastic material.

The inner incision 7 is obtained in the inner wall 8 of the sheet 2 of semirigid plastic material, is "V"-shaped, and is made by locally deforming the sheet 2 of semirigid plastic material and, in particular, all the three layers, namely the bearing layer 11, the heat-sealable layer 12 and the barrier layer 13, of the sheet 2 of semirigid plastic material. It should be pointed out that, in correspondence to the inner incision 7, the heat-sealable layer 12 and, above all, the barrier layer 13 of the sheet 2 of semirigid plastic material are locally deformed (even in an irregular manner), but they are not torn, which means that they keep their integrity. Thanks to the substantial integrity of the barrier layer 13 of the sheet 2 of semirigid plastic material, even in correspondence to the inner incision 7 made on the inner wall 8 of the sheet 2 of semirigid plastic material, it is possible to ensure a perfect insulation of the pocket 4, which, therefore, is suited to hold perishable products and/or products with a controlled bacterial load, such as food, medicines or cosmetics. Obviously, during the break-opening of the sealed package 1, obtained by "V"-folding the sealed package 1 itself, it is necessary to break, in correspondence to the pre-weakened area 6, all the three layers, namely the bearing layer 11, the heat-sealable layer 12 and the barrier layer 13, of the sheet 2 of semirigid plastic material.

According to FIGS. 3 and 4, the outer incision 9 is arranged asymmetrically in the sheet 2 of semirigid plastic material, so as to affect only one half of the sheet 2 of semirigid plastic material; in other words, the outer incision 9 is entirely arranged in one half of the sheet 2 of semirigid plastic material and, therefore, stops before the longitudinal middle axis A, which symmetrically divides the sealed package in half (namely, the outer incision 9 does not cross the longitudinal middle axis A). As a consequence, a central end of the outer incision 9 is arranged at a transverse distance (namely, one measured transversely) other than zero from the longitudinal middle axis A.

According to FIGS. 3 and 4, the outer incision 9 is arranged at a distance D1 from an outer edge of the sheet 2 of semirigid plastic material that ranges from 2 to 5 mm; in other words, a lateral end of the outer incision 9 is arranged at the distance D1—ranging from 2 to 5 mm—from the outer edge of the sheet 2 of semirigid plastic material. In particular, the lateral end of the outer incision 9 is superimposed on the projection of a welded joint WJ (shown in FIG. 4) joining the sheet 2 of semirigid plastic material to the sheet 3 of flexible plastic material. The outer incision 9 is obtained in correspondence to the outer surface 10 of the sheet 2 of semirigid plastic material, whereas the welded joint WJ between the two sheets 2 and 3 is arranged in correspondence to the inner surface 8 of the sheet 2 of semirigid plastic material, hence the outer incision 9 has no actual point of contact with the welded joint WJ between the two sheets 2 and 3; on the other hand, the lateral end of the outer incision 9 is superimposed on the projection of the welded joint WJ between the two sheets 2 and 3 onto the outer surface 10 of the sheet 2 of semirigid plastic material.

According to FIG. 3, a maximum depth P1 of the outer incision 9 is (remarkably) greater than a maximum depth P2 of the inner incision 7; preferably, the maximum depth P1 of the outer incision 9 is at least twice the maximum depth P2 of the inner incision 7. According to a preferred embodiment, the maximum depth P1 of the outer incision 9 ranges from 100 to 200 micron and the maximum depth P2 of the inner incision 7 ranges from 30 to 70 micron.

According to FIGS. 3 and 4, the outer incision is arranged so as to be transversely completely staggered relative to the inner incision 7, so that the outer incision 9 is not superimposed in any way on the projection of the inner incision 7. The outer incision 9 is obtained in correspondence to the outer surface 10 of the sheet 2 of semirigid plastic material, whereas the inner incision 7 is arranged in correspondence to the inner surface 8 of the sheet 2 of semirigid plastic material, hence the outer incision 9 has no actual point of contact with the inner incision 7; furthermore, a central end of the outer incision 9 is transversely spaced apart from the projection of a central end of the inner incision 7 onto the outer surface 10 of the sheet 2 of semirigid plastic material. Preferably, the central end of the outer incision 9 is arranged at a distance D2 from the central end of the inner incision 7 that is measured transversely, is other than zero (namely, greater than zero) and preferably ranges from 2 to 8 mm.

Figure 6:
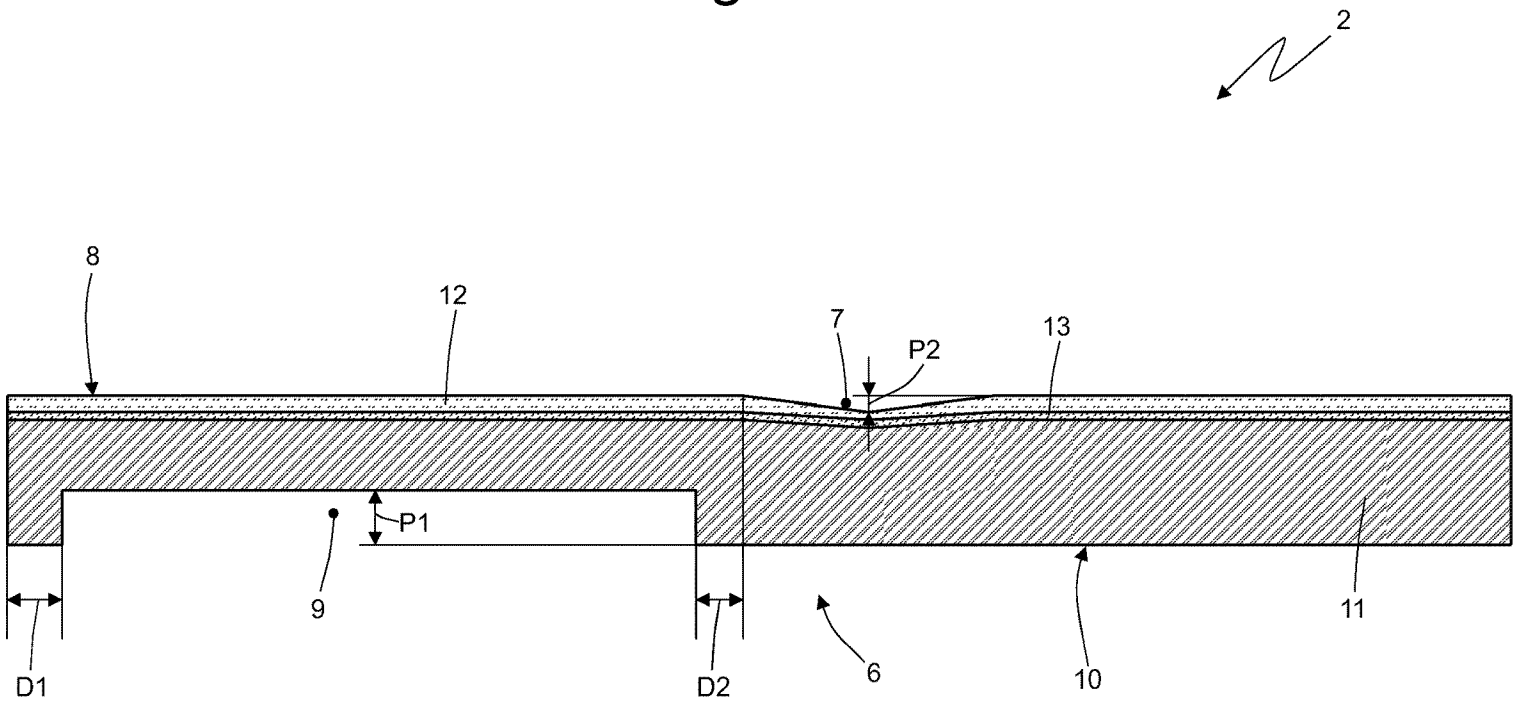
FIG. 6 is a schematic, cross-sectional view, in correspondence to a pre-weakened area, of a variant of the sealed package of FIG. 1.

In the embodiment shown in FIG. 3, the inner incision 7 has, transversely and along its length, a variable depth; this feature is preferable in order to improve the opening of the sealed package 1, when the sealed package 1 is folded in a "V" shape (as shown in FIG. 5). In other words, the fact that the inner incision 7 has, transversely and along its length, a variable depth allows users to obtain a progressive opening of the sheet 2 of semirigid plastic material, when the sealed package 1 is folded in a "V" shape (as shown in FIG. 5). In the embodiment shown in FIG. 3, the outer incision 9 has, transversely and along its length, a variable depth; this feature is not strictly necessary, since the outer incision 9 might also have, transversely and along its length, a constant depth (as shown in the variant represented in FIG. 6). In the embodiment shown in FIG. 3, both incisions 7 and 9 have, in their cross-sectional view, a shape and, therefore, they have the maximum depth at the centre; according to other embodiments that are not shown herein, the incisions 7 and 9 might also have, in their cross-sectional view, shapes that are different from the "V" shape.

According to FIG. 5, the sealed package 1 is opened in a vertical position; namely, the sealed package 1 is oriented vertically and then it is folded in a "V" shape until the sheet 2 of semirigid plastic material brakes in correspondence to the pre-weakened area 6. When the sealed package 1 is folded in a "V" shape, the sheet 2 of semirigid plastic material brakes between the two incisions 7 and 9, thus determining the formation of a channel connecting the two incisions 7 and 9; through this channel, the product 5 contained in the pocket 4 flows out; the product 5 vertically flows downwards along the outer incision 9 and then abandons the sealed package 1 in correspondence to the lower area of the corner of the "V" (as shown in FIG. 5). The lower area of the corner of the "V" is made up of an intact part (namely, one that is not affected by the outer incision 9) of the sheet 2 of semirigid plastic material, which has a length that is equal to the distance D1 (existing between the lateral end of the outer incision 9 and the outer edge of the sheet 2 of semirigid plastic material); the lower area of the corner of the "V" fulfils an important task, since it creates a "spout", which allows users to significantly improve the control of downward direction of the product 5 flowing out of the sealed package 1.

As already mentioned above, the distance D1 existing between the lateral end of the outer incision 9 and the outer edge of the sheet 2 of semirigid plastic material ranges from 2 to 5 mm; smaller values of the distance D1 do not allow users to obtain a good control of the downward direction of the product 5 flowing out of the sealed package 1, whereas greater values of the distance D1 tend to provoke the creation of horizontally aimed squirts (which are clearly undesired) of the product 5 flowing out of the sealed package 1.

It should be pointed out that the sealed package 1 might also be opened in a horizontal position, namely when it oriented horizontally; however, the sealed 1 packages is designed to be opened in a vertical position, which is the position that is most frequently used to open the sealed package 1.

In the embodiment shown in the accompanying drawings, the sealed package 1 has a rectangular shape; obviously, due to aesthetic reasons, the sealed package 1 could also have any other shape: a circular shape, an elliptic shape, a "bottle"-like shape, a rhomboidal shape, a pentagonal shape, a hexagonal shape, a triangular shape, a square shape, a "bone"-like shape. Obviously, the outer surface of the sheet 2 of semirigid plastic material and/or the outer surface of the sheet 3 of flexible plastic material can be printed both to display information on the product 5 and to improve the look of the package.

The sealed package 1 described above has numerous advantages.

First of all, the sealed package 1 described above can be opened in a vertical position (as shown in FIG. 5), thus allowing users to accurately direct the product 5, so as to hit the centre of a relatively small-sized opening arranged under the sealed package 1.

Furthermore, the product 5 flows out of the sealed package 1 described above, which is folded in a "V" shape (as shown in FIG. 5), by vertically sliding along the outer incision 9 and by then vertically moving, due to gravity, from the lower corner (arranged immediately under the outer incision 9 and aligned with the outer incision 9 itself); in this way, the product 5 flows out of the sealed package 1, which is folded in a "V" shape (as shown in FIG. 5), with a direction that is always constant and easily foreseeable, thus making it even easier for the product 5 to hit the centre of a relatively small-sized opening arranged under the sealed package 1.

Finally, the sealed package 1 described above can be manufactured in a straightforward and relatively low-cost manner, since it is manufactured with a procedure that is similar to the one used to produce a standard sealed package; namely, the sealed package 1 described above can be manufactured by making a few simple changes to an existing machine to manufacture standard sealed packages.

It should be pointed out that, in the sealed package 1 described above, the breakage of the sheet 2 of semirigid plastic material takes place only if the sealed package 1 is folded crosswise (i.e. parallel to the pre-weakened area 6) by a fairly large angle (typically, at least 70-90°); as a consequence, the possibility to accidentally brake the sheet 2 of semirigid plastic material in correspondence to the pre-weakened area 6, when handling the sealed package 1, is highly unlikely.

The invention claimed is:

1. A sealed single-dose break-open package; the sealed package has a longitudinal direction and a transverse direction, which is perpendicular to the longitudinal direction, and comprises:

a first sheet of semirigid plastic material;

a second sheet of flexible plastic material superimposed on and sealed to the first sheet of semirigid plastic material to define a sealed pocket containing a dose of a product; and a pre-weakened area, which extends transversely and is disposed in a central area of the first sheet, so as to guide, following a folding of the sealed package, a controlled breakage of the first sheet in correspondence to the pre-weakened area, in order to cause the formation of an outlet opening for the product through the first sheet;

wherein the pre-weakened area comprises a single inner incision, which is oriented transversely and is formed through an inner surface of the first sheet, and a single outer incision, which is oriented transversely, is formed through an outer surface of the first sheet, and is transversely staggered relative to and longitudinally aligned with the inner incision;

wherein the outer incision is arranged asymmetrically in the first sheet, so as to affect only one half of the first sheet;

wherein the outer incision is arranged at a distance from an outer edge of the first sheet that ranges from 2 to 5 mm;

wherein a maximum depth of the outer incision is greater than a maximum depth of the inner incision; and wherein the outer incision has, transversely and along its length, a variable depth.

2. A sealed single-dose package according to claim 1, wherein the outer incision is arranged so as to be transversely completely staggered relative to the inner incision, so that the outer incision is not superimposed in any way on a projection of the inner incision onto the outer surface.

3. A sealed single-dose package according to claim 2, wherein a central end of the outer incision is arranged at a distance from a central end of the inner incision that is measured transversely and ranges from 2 to 8 mm.

4. A sealed single-dose package according to claim 1, wherein the maximum depth of the outer incision is at least twice the maximum depth of the inner incision.

5. A sealed single-dose package according to claim 1, wherein the maximum depth of the outer incision ranges from 100 to 200 micron.

6. A sealed single-dose package according to claim 1, wherein the maximum depth of the inner incision ranges from 30 to 70 micron.

7. A sealed single-dose package according to claim 1, wherein a central end of the outer incision is arranged at a transverse distance other than zero from a longitudinal middle axis.

8. A sealed single-dose package according to claim 1, wherein a lateral end of the outer incision is superimposed on a projection onto the outer surface of a welded joint joining the first sheet to the second sheet.

9. A sealed single-dose package according to claim 1, wherein the inner incision has, transversely and along its length, a variable depth.

10. A sealed single-dose break-open package; the sealed package has a longitudinal direction and a transverse direction, which is perpendicular to the longitudinal direction, and comprises:

a first sheet of semirigid plastic material;

a second sheet of flexible plastic material superimposed on and sealed to the first sheet of semirigid plastic material to define a sealed pocket containing a dose of a product; and a pre-weakened area, which extends transversely and is disposed in a central area of the first sheet, so as to guide, following a folding of the sealed package, a controlled breakage of the first sheet in correspondence to the pre-weakened area, in order to cause the formation of an outlet opening for the product through the first sheet;

wherein the pre-weakened area comprises a single inner incision, which is oriented transversely and is formed through an inner surface of the first sheet, and a single outer incision, which is oriented transversely, is formed through an outer surface of the first sheet, and is transversely staggered relative to and longitudinally aligned with the inner incision;

wherein the outer incision is arranged asymmetrically in the first sheet, so as to affect only one half of the first sheet;

wherein the outer incision is arranged at a distance from an outer edge of the first sheet that ranges from 2 to 5 mm; and wherein a maximum depth of the outer incision is greater than a maximum depth of the inner incision;

wherein a lateral end of the outer incision is superimposed on a projection onto the outer surface of a welded joint joining the first sheet to the second sheet.

* * * * *